US008484770B2

(12) United States Patent
Desai

(10) Patent No.: US 8,484,770 B2
(45) Date of Patent: Jul. 16, 2013

(54) TOILET FOR THE DISABLED

(76) Inventor: Kishor C. Desai, Winter Park, FL (US)

( * ) Notice: Subject to any disclaimer, the term of this patent is extended or adjusted under 35 U.S.C. 154(b) by 0 days.

(21) Appl. No.: 13/609,189

(22) Filed: Sep. 10, 2012

(65) Prior Publication Data

US 2013/0000028 A1 Jan. 3, 2013

Related U.S. Application Data

(63) Continuation-in-part of application No. 12/586,951, filed on Sep. 30, 2009, now abandoned.

(51) Int. Cl.
*E03D 11/00* (2006.01)

(52) U.S. Cl.
USPC ..... 4/420

(58) Field of Classification Search
USPC ..... 4/420, 254
See application file for complete search history.

(56) References Cited

U.S. PATENT DOCUMENTS

| | | | | |
|---|---|---|---|---|
| D179,696 | S | | 2/1957 | Bidet |
| 3,398,410 | A | | 8/1968 | Sparling |
| 3,500,480 | A | | 3/1970 | Michal, Jr. |
| 3,565,106 | A | | 2/1971 | Baumbach |
| 3,798,681 | A | | 3/1974 | Johansen |
| 3,801,991 | A | | 4/1974 | Fulton et al. |
| 3,858,249 | A | | 1/1975 | Howard |
| 3,883,903 | A | | 5/1975 | Broek et al. |
| 3,905,049 | A | | 9/1975 | Stokes |
| 3,939,501 | A | | 2/1976 | Sargent |
| 3,986,216 | A | | 10/1976 | Davis et al. |
| 3,994,028 | A | | 11/1976 | Abom et al. |
| 4,715,069 | A | * | 12/1987 | James ..... 4/254 |
| 4,882,791 | A | * | 11/1989 | Kimes ..... 4/254 |
| 1,894,871 | A | | 1/1990 | Schmerier |
| 4,894,871 | A | * | 1/1990 | Schmerler ..... 4/254 |
| 5,065,462 | A | | 11/1991 | Romano |
| D353,450 | S | | 12/1994 | Anderson et al. |
| D503,465 | S | | 3/2005 | Gustafsson |
| 7,194,772 | B2 | | 3/2007 | Rie |
| D603,028 | S | | 10/2009 | Kergoet |
| D650,054 | S | | 12/2011 | Desai |
| D651,700 | S | | 1/2012 | Desai |

FOREIGN PATENT DOCUMENTS

JP 6-304092 11/1994

* cited by examiner

*Primary Examiner* — Huyen Le
(74) *Attorney, Agent, or Firm* — Richard C. Litman

(57) ABSTRACT

The toilet for the disabled has a toilet bowl and toilet seat configured to face the toilet tank, thereby enabling disabled and physically debilitated persons to move forward to sit on the toilet seat. The toilet has a pedestal on which the tank is mounted, and an inverted U-shaped support member having legs attached to opposite sides of the pedestal. The support member includes a crossbar handle above the level of the tank that a disabled person may grasp for assistance in moving forward onto the toilet seat and rearward off the toilet seat. The handle may have a resilient grip. The toilet may have two independently flush handle mounted on opposite sides of the tank for operation by right-handed or left-handed users.

6 Claims, 5 Drawing Sheets

TOILET FOR THE DISABLED

CROSS-REFERENCE TO RELATED APPLICATIONS

This application is a continuation-in-part of my prior U.S. nonprovisional patent application Ser. No. 12/586,951, filed Sep. 30, 2009, now abandoned which is hereby incorporated by reference in its entirety.

BACKGROUND OF THE INVENTION

1. Field of the Invention

The present invention relates to plumbing fixtures, and particularly to a toilet for the disabled that is specifically designed for handicapped persons, as well as anyone having difficulty using a conventional.

2. Description of the Related Art

Conventional toilets are all arranged with the broader part of the seat (the part on which the user sits/places their buttocks) positioned at the rear, meaning nearest to the cistern/flushing tank, and the seat narrows towards the front. This is true for all toilets, whether close-coupled or not, and whether for the able-bodied or for the physically or mentally disabled. In toilets designed for the disabled, a handlebar may be provided to assist them in moving to and from the toilet, but this is normally positioned extending in a plane parallel to the front-rear axis of the toilet, either at the right- and/or left-hand side of the toilet.

For those with physical or mental disabilities, such as Muscular Dystrophy, Alzheimer's, spinal injuries or amputees, they generally have no choice but to use these conventional toilets, since there are no options available to them. They are, however, far from ideal for the disabled. A major problem with conventional toilet design is that when a wheelchair-bound disabled person wants to use the toilet, it is difficult for him/her to get off the wheelchair to make the transfer onto the toilet. The wheelchair user must turn 180° and maneuver onto the toilet set.

Even for those who provide care for wheelchair users, it is hard for the caregiver to get the wheelchair user off of the wheelchair, carry them to the toilet, turn them around, and put them on the toilet seat. It is a cumbersome process, and a back-breaking job for the caregiver.

Thus, a toilet for the disabled solving the aforementioned problems is desired.

SUMMARY OF THE INVENTION

The toilet for the disabled includes a toilet bowl, a toilet seat, and a toilet bowl lid having a design configuration for reversed western toilet seating. In this manner, a user can access the toilet seat easily from a wheelchair by shifting forward from the wheelchair onto the toilet, and can easily move from the toilet to the wheelchair. A toilet tank or cistern coupled to the toilet bowl maintains a reservoir of water. Typically, a flush handle is disposed on either side of the tank or cistern, allowing the user to reach the flush handle with little effort. The tank or cistern sits atop a pedestal, which is anchored to the floor or other supporting structure. The toilet bowl communicates with the tank via the pedestal so that the flush water travels from the tank through the pedestal to the bowl, and finally through a drain to dispose of waste after use.

The toilet also has a support handlebar attached to the pedestal. The support handlebar has a substantially inverted U-shaped member made from a rigid material. The legs of the inverted U-shaped member are attached to the pedestal, and extend vertically between the toilet tank and the toilet bowl. The top of the support handlebar provides a handle that extends horizontally between the legs across the width of the toilet. The handle may be covered with a resilient material for comfort. In use, the handle allows the user to maintain stability, balance, and coordination while using the toilet. The resilient material is formed of a substance resistant to microbes, bacteria, and other microorganisms, thus reducing the risk of spreading disease and infections to different users.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
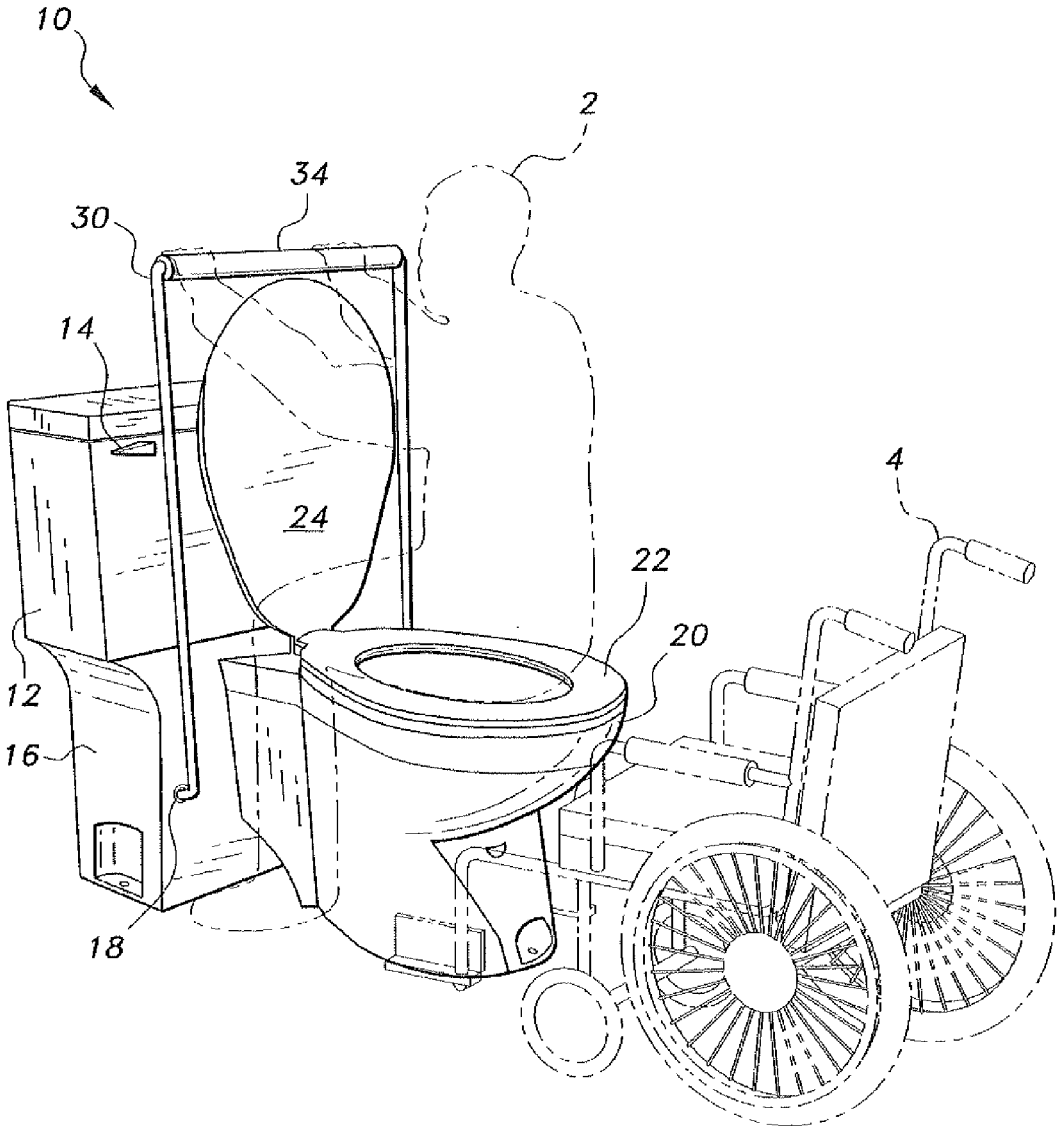
FIG. 1 is an environmental perspective view of a first embodiment of a toilet for the disabled according to the present invention, showing a user in phantom demonstrating the manner of use.

Referring to FIG. 1, a first embodiment of the toilet for the disabled, designated generally as 10 in the drawings, is illustrated in use. The user 2 is able to slide forward from a wheelchair 4 onto the toilet seat 22 of the toilet bowl 20. The body of the user 2 is not rotated, nor does the user 2 have to push the wheelchair 4 away in order to have room to the exercise the functions of the body. Also, the user 2 simply slides backward from the toilet seat 22 into the wheelchair once completed. Thus, the toilet for the disabled 10 gives freedom of mobility and easier access to accomplish toilet functions.

Figure 2:
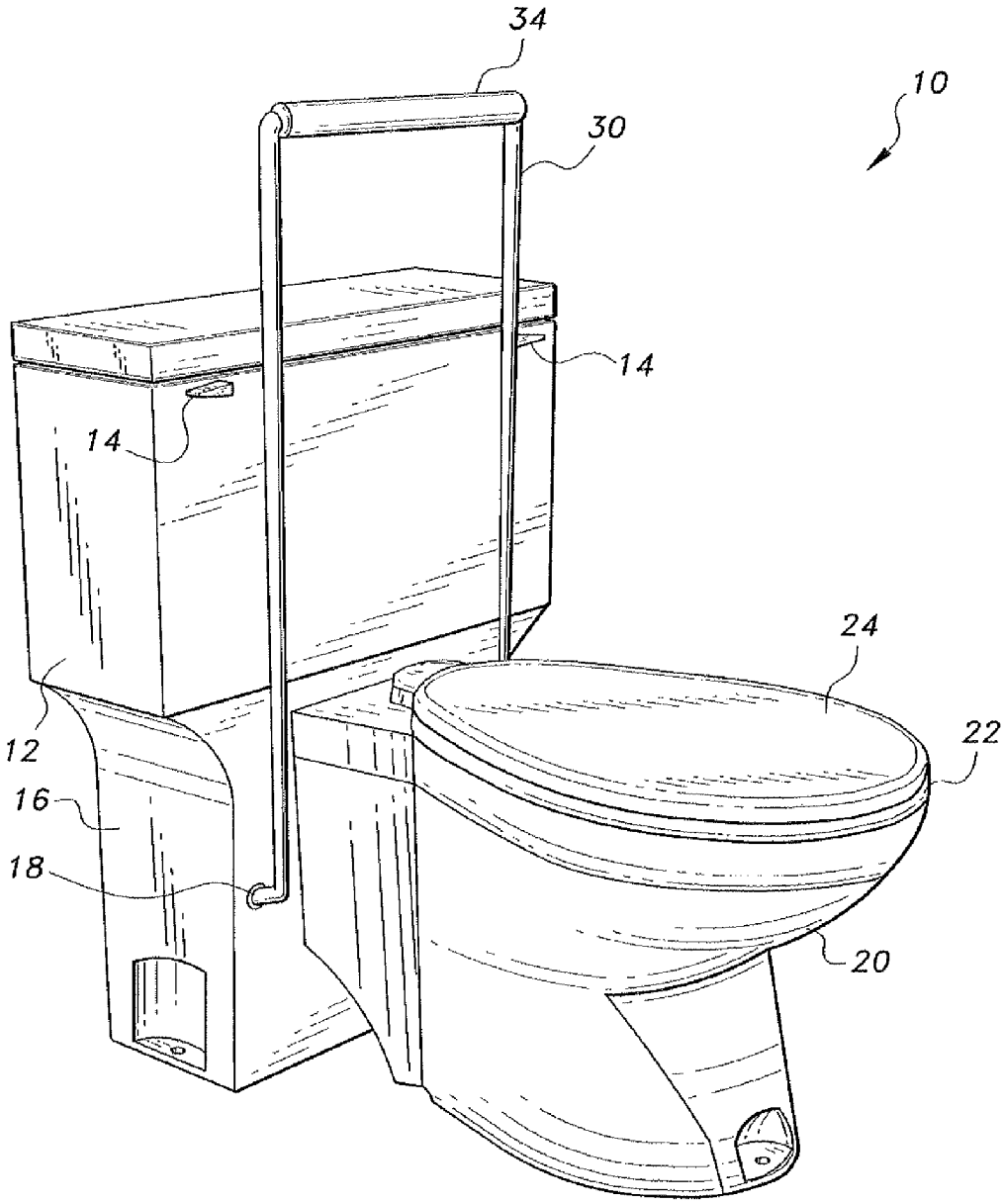
FIG. 2 is perspective view of the toilet of FIG. 1.
Figure 3:
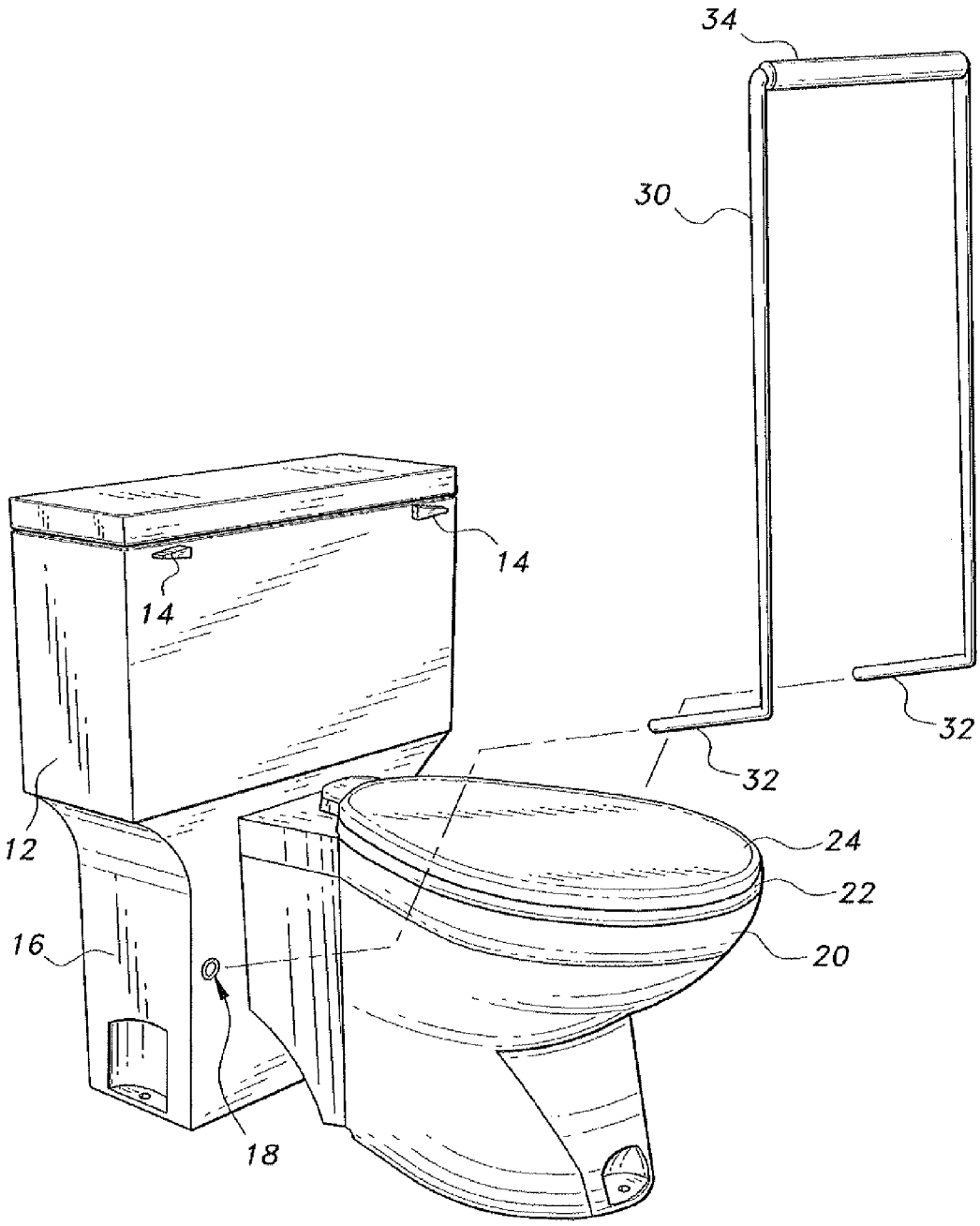
FIG. 3 is a partially exploded perspective view of the toilet of FIG. 1.

Referring to FIGS. 1-3, the toilet includes a tank 12 having a lid. The tank 12 is a reservoir of water to be used for flushing or evacuating waste from the toilet. The tank 12 supports at least one flush handle 14. The figures illustrate a preferred arrangement of two flush handles 14 (seen most clearly in FIG. 3 positioned on opposite sides of the tank 12. The two flush handles 14 provide access for a user 2 having limited or restricted arm mobility. For example, in case the user 2 is lacking a left arm, a conventional toilet typically has a single handle positioned on the left side of the tank 12, creating difficulty for the user 2 to flush with the usable right arm. Therefore, providing a flush handle 14 on each side of the tank 12 provides greater accessibility for the disabled person, providing the option of using either flush handle 14. Alternatively, the flush handle may be a centrally mounted flush handle, or the toilet 10 may have an automatic flushing system in lieu of the oppositely disposed flush handles 14.

The tank 12 sits atop a pedestal 16. Pedestal 16 provides a stable base and anchor for the toilet 10. The pedestal 16 is secured to the supporting structure, such as a floor, in a conventional manner. The pedestal 16 includes the necessary conduits to allow water to flow from the tank 12 into the toilet bowl 20, and to refill the tank 12. In addition, the pedestal 12 has a pair of receiving orifices or sockets 18 disposed on opposite sides of the pedestal 18. The receiving orifices or sockets 18 serve as the attachment locations for a support bar 30.

The toilet bowl 20 has the toilet seat 22, and a toilet lid 24. Both the toilet seat 22 and the toilet lid 24 are each independently pivotally attached to the toilet bowl 20 by hinges. The toilet bowl 20, the toilet seat 22, and the toilet lid 24 are designed and configured in a reverse fashion from the standard western type toilets. This means that the wider portion of the toilet bowl 20 and the toilet seat 22 are forward and the narrower portions of the toilet bowl 20 and the toilet seat are closest to the pedestal 16 and tank 12, which funnels waste matter towards a forward drain. The toilet bowl floor drain and S-trap or P-trap are also forward and reversed from their conventional configuration, rather than rearward, as in a conventional toilet bowl. In other words, the toilet bowl and its internal drain plumbing are reversed 180° from a conventional toilet bowl. This allows the user 2 to access the toilet for the disabled 10 without having to maneuver about a 180° turn from a wheelchair 4.

The support bar 30 is preferably formed of a rigid material that provides a strong and stable handle for the user 2 to hold onto while sliding to and from the wheelchair 4. The support bar 30 has a generally inverted U-shape configuration. As seen in FIG. 3, the ends of the inverted U-shape of the support bar 30 have angled ends 32 that matingly engage with the receiving orifices or sockets 18 of the pedestal 16. The top crossbar of the inverted U-shape support bar 30 may be provided with a resilient material or padding 34 to provide a comfortable area for the user 2 to grasp. Although the use of the resilient material or padding 34 is preferable, the use of such material or padding 34 is optional. As long as the surface is dimensioned and configured to be graspable, the support bar 30, when the angled ends 32 are inserted into the receiving orifices or sockets 18 of the pedestal 16, becomes a safety structure to assist those that are disabled to independently use the toilet 10. The legs of the support bar 30 raise the crossbar to a height that is above the tank 12 and provides sufficient clearance to raise and lower the toilet lid 24, while being at a height convenient for a wheelchair-bound user to grasp for assistance in in pulling, pushing, or steadying maneuvers that may be required to move on or off the toilet seat 22.

It is noted that the resilient material or padding 34 is preferably formed from a bacterial and microbial resistant substance to reduce the possibility of contact with infectious or contagious disease carriers.

Figure 4:
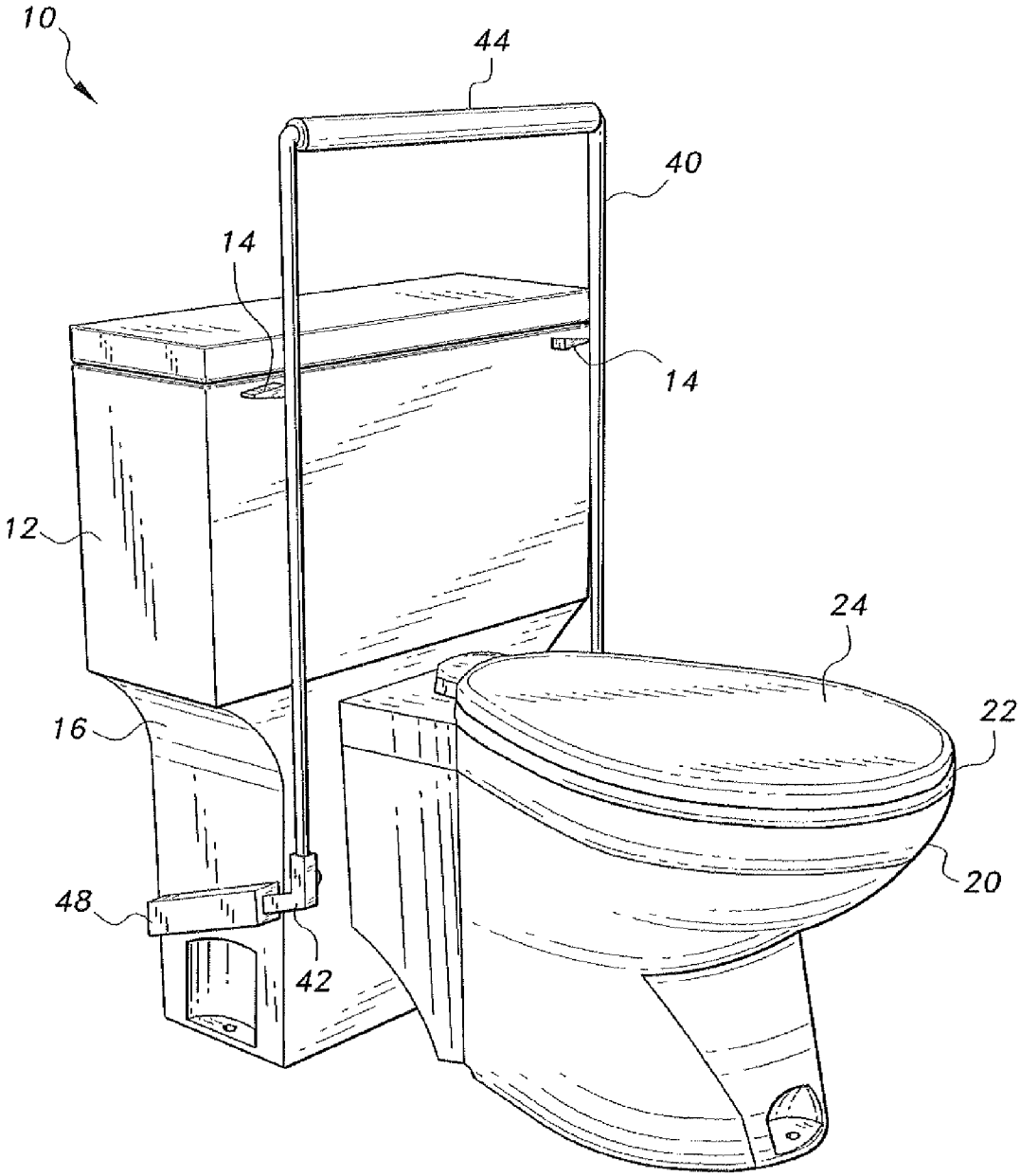
FIG. 4 is a perspective view of a second embodiment of a toilet for the disabled according to the present invention.
Figure 5:
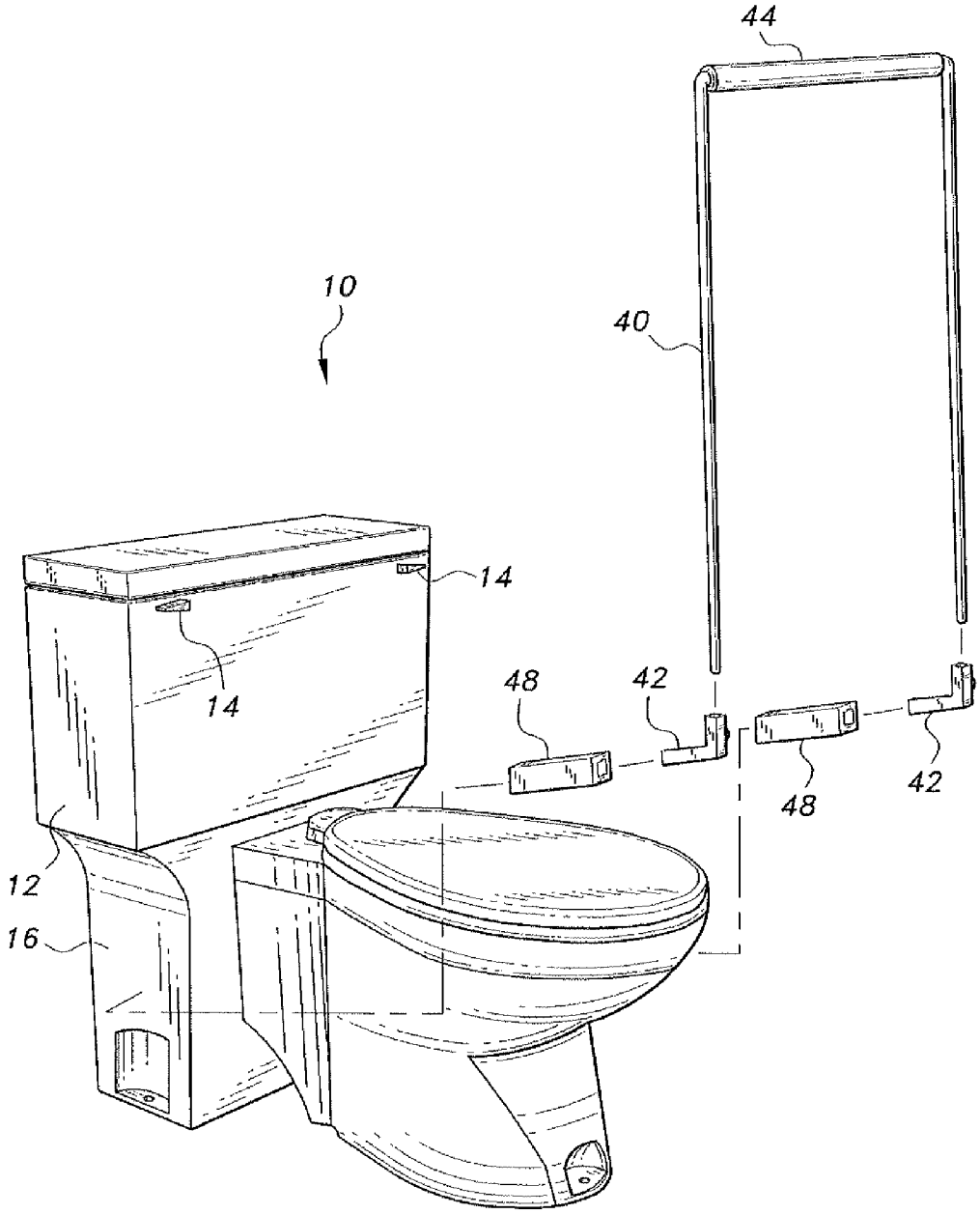
FIG. 5 is a partially exploded perspective view of the toilet of FIG. 4.

Referring to FIGS. 4 and 5, a second embodiment of a toilet for the disabled is illustrated. In this embodiment, the user 2 likewise will be able to slide from the wheelchair 4 onto the toilet seat 22. The components of the toilet 10 are substantially identical in the two embodiments. The support bar 40 of the embodiment of FIGS. 4 and 5 also has a generally inverted U-shape, the top crossbar being covered with a resilient material or padding 44. The resilient material or padding 44 provides a comfortable area for the user 2 to grasp onto the support bar 40. Although the use of the resilient material or padding 44 is preferable, the material or padding 44 is optional. The surface is dimensioned and configured to be grasped by a user. It is noted that the resilient material or padding 44 is preferably formed from a bacterial and microbial resistant substance to reduce the possibility of contact with infectious or contagious disease carriers.

In order to attach the support bar 44 to the pedestal 16, the receiving orifices or sockets 18 are useable if the toilet is so equipped. However, if the support bar 44 is retrofitted to an existing toilet, then this second embodiment provides a solution. Two tubular members 48 are rigidly attached to the pedestal 16 in a suitable manner (such as cementing, bolting, etc.), so long as the tubular members 48 are firmly secured to the pedestal 16. The support bar 44 is shown to terminate in straight ends. Each one of the straight ends of the support bar 44 engages an angled foot coupler 42. The angled foot couplers 42 securely engage the tubular members 48, respectively, thereby anchoring the support bar 44 to the pedestal 16 of the toilet 10. Likewise, it is understood that the support bar 30 shown in FIGS. 1-3 is useable with the tubular members 48 of FIGS. 4 and 5, and the support bar 40 is usable with the angled foot couplers 42 and the receiving orifices or sockets 18 of the pedestal 16.

It is to be understood that the present invention is not limited to the embodiments described above, but encompasses any and all embodiments within the scope of the following claims.

I claim:

1. A toilet for the disabled, comprising:

a pedestal adapted for mounting on a floor;

a toilet tank mounted on the pedestal;

a toilet bowl connected to the pedestal and the toilet tank, the tank defining a water reservoir for flushing and refilling the toilet bowl, the toilet bowl having a seat pivotally attached thereto, the bowl and the seat having a narrow portion adjacent the pedestal and tank and a wider portion extending forward from the narrow portion, whereby the bowl and the seat are adapted for use by a user sitting on the seat facing the tank; and a support member having a pair of parallel legs and a crossbar handle defining an inverted U-shaped configuration, the legs being attached to opposite sides of the pedestal, the legs extending vertically, the handle being raised to a height above the tank and extending for a width greater than the toilet howl, whereby the handle may be grasped with both hands by a disabled user and used to support the user while moving forward onto the toilet seat.

2. The toilet according to claim 1, wherein:

said pedestal has mounting sockets formed therein on opposite sides of said toilet tank; and the legs of said support member have lower ends angled towards said pedestal, the lower ends being secured in the sockets to attach said support member to said pedestal.

3. The toilet according to claim 1, further comprising a pair of sockets rigidly attached to opposite sides of said pedestal, the legs of said support member having lower ends angled towards said pedestal, the lower ends being secured in the sockets to attach said support member to said pedestal.

4. The toilet according to claim 1, further comprising:

a pair of sockets rigidly attached to opposite sides of said pedestal; and a pair of angled couplers connecting the legs of said support members to the sockets, the couplers being secured in the sockets to attach said support member to said pedestal.

5. The toilet according to claim 1, further comprising a pair of flush handles mounted on opposite sides of said tank, the flush handles being independently operable to release water from the tank reservoir to flush the toilet bowl.

6. The toilet according to claim 1, further comprising a resilient grip disposed on said crossbar handle.

* * * * *